US005925860A

United States Patent [19]

Lee

[11] Patent Number: 5,925,860

[45] Date of Patent: Jul. 20, 1999

[54] ROTARY CONTROL DEVICE, AND ELECTRONIC APPARATUS USING IT

[75] Inventor: Joung Hoon Lee, Suwon, Rep. of Korea

[73] Assignee: Samsung Electronics Co., Ltd., Kyungki-Do, Rep. of Korea

[21] Appl. No.: 08/965,045

[22] Filed: Nov. 5, 1997

[30] Foreign Application Priority Data

Jan. 30, 1999 [KR] Rep. of Korea ..... 97-2791

[51] Int. Cl.[6] ..... H01H 3/20

[52] U.S. Cl. ..... 200/18; 200/1 R; 200/5 E; 200/17 R

[58] Field of Search ..... 200/1 R, 5 R, 200/17 R, 18, 43.01, 52 R, 61.58 R, 61.61, 61.62, 520, 293, 294, 296, 329, 336, 338, 341, 4, 5 E, 43.16, 333; 361/679, 680, 686, 724, 725, 727, 728; 400/473, 477, 479

[56] References Cited

U.S. PATENT DOCUMENTS

| | | | |
|---|---|---|---|
| 4,939,514 | 7/1990 | Miyazaki | 341/22 |
| 5,193,667 | 3/1993 | Choi | 200/331 |
| 5,623,393 | 4/1997 | Yau | 361/682 |

*Primary Examiner*—Michael A Friedhofer
*Attorney, Agent, or Firm*—Sughrue, Mion, Zinn, Macpeak & Seas, PLLC

[57] ABSTRACT

A rotary control device and an electronic apparatus in which it is used are disclosed. The control device includes a flat cylindrical switch plate for selectively exposing function switches to the outside of the electronic apparatus in accordance with rotation of the switch plate. A plurality of switches are disposed on the switch plate, for generating manipulating signals. The switches are disposed along the circumference of the switch plate, and are selectively exposed to the outside of the electronic apparatus. The user can rotate the switch plate clockwise or counterclockwise to selectively expose the intended switches for activation.

20 Claims, 4 Drawing Sheets

ROTARY CONTROL DEVICE, AND ELECTRONIC APPARATUS USING IT

BACKGROUND OF THE INVENTION

1. Field of the Invention

The present invention relates to a control device and an electronic apparatus in which it is used. Various function switches are formed in the control device for use in electronic apparatuses such as televisions, audio sets and the like. More specifically, the present invention relates to a rotary control device and an electronic apparatus in which it is used. The rotary control device is installed within an electronic apparatus, and can be rotated in two directions to expose function switches selectively to the outside of the electronic apparatus.

2. Description of the Related Art

Generally, in various electronic apparatuses such as televisions, audio sets and the like, there are various function switches for controlling operations such as power, audio and video adjusting and the like. The function switches are located on the front faces of the electronic apparatuses. Recently, in order to improve the aesthetic appearance of the apparatus and to improve the durability of the apparatus, the function switches were hidden within a control box, so that the function switches would not be exposed to the outside when not in use.

FIG. 1 illustrates a television set provided with a conventional control device. As shown in FIG. 1, the control device is installed under the screen. A door 2 which can be closed by pivoting is secured by a hinge on television body 1. When the control device is not in use, the door 2 is closed, so that the manipulation switches are not exposed to the outside. When the control device is to be used, the upper portion of the door 2 is pulled out to expose the control device.

In FIG. 1, the door 2 is open, and the switches are exposed. Function switches such as a power switch, a channel switch, an audio switch and the like are installed on the rear face of the door 2.

In another conventional technique, the switches are installed on the television body in such a manner that they are exposed only when the door 2 is open.

The conventional control device is not exposed when not in use, and therefore, the aesthetic appearance of the television set is improved. However, when the door 2 is open, if an external force is applied to the door by a child or the like, the hinge of the door may be easily damaged. Further, as the functions of the electronic apparatus are diversified, the number of the function switches increases. Accordingly, the size of the door 2 has to be increased, resulting in difficulty keeping the multi-function electronic apparatus compact.

SUMMARY OF THE INVENTION

The present invention is intended to overcome the above described disadvantages of the conventional techniques.

Therefore it is an object of the present invention to provide a rotary control device for an electronic apparatus, in which the conventional problems are all solved.

It is another object of the present invention to provide a rotary control device for an electronic apparatus, in which the function switches are selectively exposed, so that the aesthetic appearance is not aggravated and inadvertent damage to the door is prevented.

It is still another object of the present invention to provide a rotary control device for an electronic apparatus, in which the function switches occupy a small area compared with the number of the function switches, so that the electronic apparatus can be made compact.

In achieving the above objects, the control device for an electronic apparatus according to the present invention includes: a rotatable switch plate for selectively exposing some function switches to an outside of the electronic apparatus; a switch means disposed on the switch plate, for generating manipulating signals; a means for transmitting the manipulating signals of the switches to the electronic apparatus; and a supporting means for rotatably supporting the switch plate.

The switch plate may take various shapes, but to increase its utility within a narrow space, a flat cylindrical shape is preferable. On the flat face of the switch plate, there are installed switches such as tack switches and rotary switches.

Further, in order to easily rotate the switch plate by hand, there are formed projections on a side of the switch plate. The projections may take any form that increases the friction between the fingers and the switch plate.

In order to prevent rotation of the switch plate during manipulation of the switches, there can be braking means, a pawl and ratchet, and gear trains disposed at various angular positions around the switch plate.

The supporting means includes: a supporting part extending downward from the center of the bottom of the switch plate; a bracket for securing the switch plate to the body of the electronic apparatus; and a supporting shaft, fixed to the bracket, for rotatably supporting the supporting part. Further, the supporting means may take any form that can rotatably support the switch plate.

The transmitting means consists of a multiple channel or segmented cable with one end connected to the switch plate, and with its other end connected to the circuits of the electronic apparatus. However, besides a cable, there can be used contact metals. In the case where a cable is used, a means for limiting the rotation of the switch plate should preferably be used so as to prevent twisting the cable.

BRIEF DESCRIPTION OF THE DRAWINGS

The above objects and other advantages of the present invention will become more apparent by describing in detail the preferred embodiment of the present invention with reference to the attached drawings in which.

DETAILED DESCRIPTION OF THE PREFERRED EMBODIMENT

The preferred embodiment of the present invention will be described below, but the present invention is not limited to the preferred embodiment which is merely exemplary.

Figure 1:
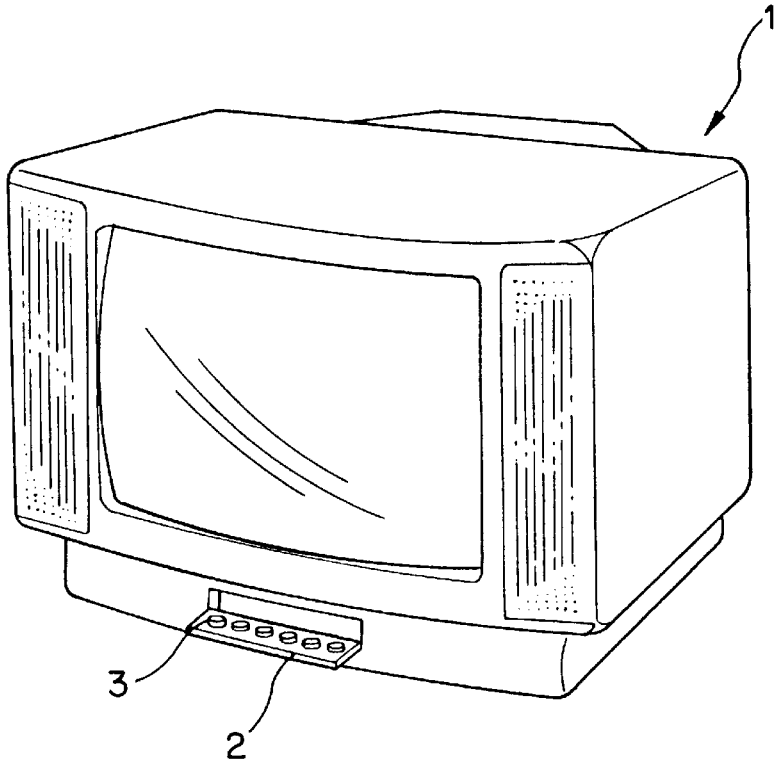
FIG. 1 PRIOR ART
FIG. 1 is a perspective view showing a television with a conventional control device provided thereon.
Figure 2:
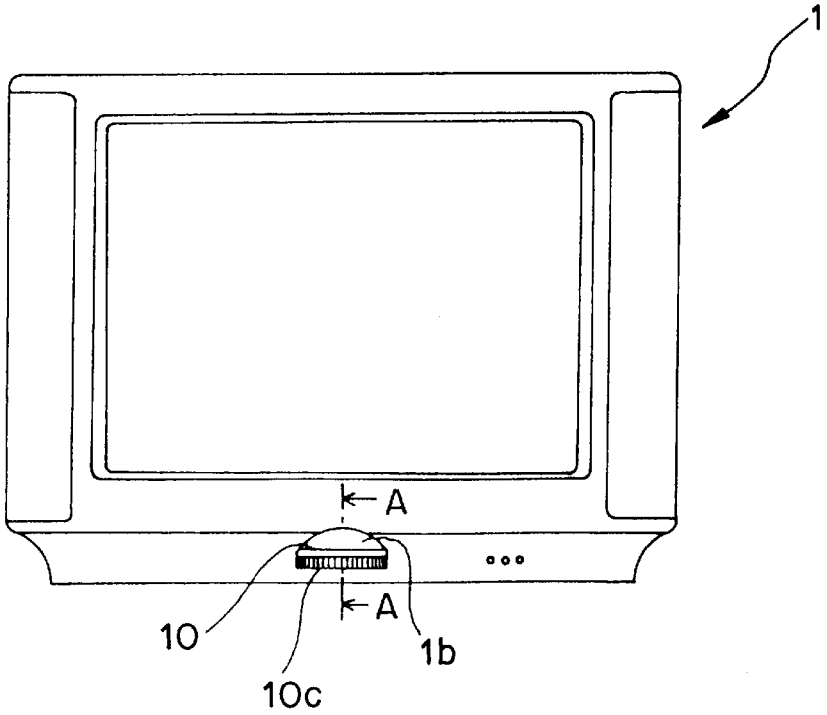
FIG. 2 a frontal view of a television with the control device of the present invention installed thereon.

As shown in FIG. 2, a rotary control device is applied to a television which is one example of the many electronic apparatuses to which the present invention could be applied.

The rotary control device 10 is installed under the cathode ray tube of the television 1. A portion of the body of the television is cut out for an easy access to the control device 10.

Figure 3:
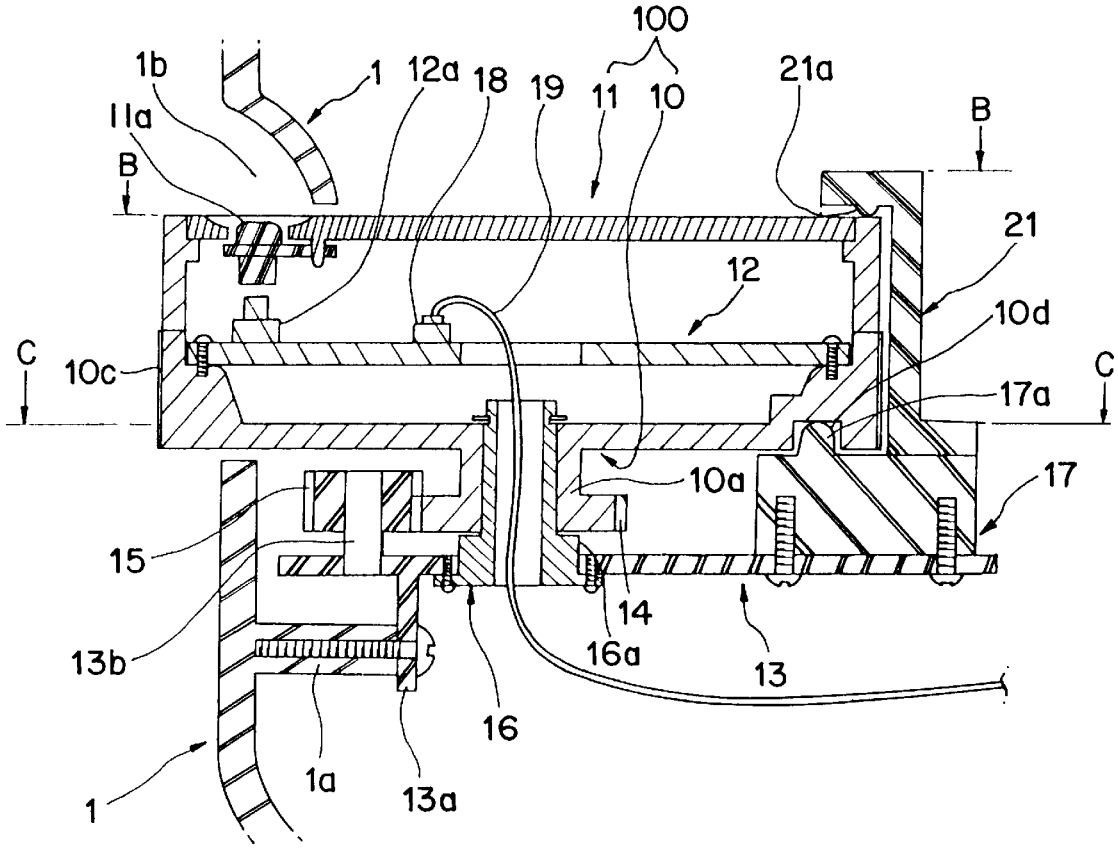
FIG. 3 sectional view taken along a line A—A of FIG. 2.

FIG. 3 is a sectional view taken along a line A—A of FIG. 2. A switch plate 100 includes a case 10 and a cover 11. A base board 12 is installed within the case 10, so that signals can be generated upon pressing a tack switch 12*a* through pressure on knob 11*a*. Base board 12 can be a printed circuit board. Tack switches 12*a* are connected to a multiple channel or segmented cable 19 by a printed circuit (not shown) on base board 12. The signals are transmitted from the tack switches through the printed circuit and then through separate channels in segmented cable 19 (connected to the base board 12) to a control board of the television. The base board is secured to the case 10 by screws. The switch plate 100 includes: a hollow supporting part 10*a* formed on the bottom of the switch plate; an arcuate groove 10*d* formed on the bottom of the switch plate; and projections 10*c* for increasing friction between fingers and the side of the switch plate. A hollow supporting shaft 16 which is secured to a bracket 13 is inserted into the hollow supporting part 10*a*. The cable 19 is connected through a hollow space to the control circuits of the television. In the preferred embodiment, in order to prevent contact between gear 14 and the bracket 13, there is formed a step 16*a* on the supporting shaft 16. The bracket 13 is fixedly attached to the body of the television 1 by a screw. On the frontal face of the bracket 13, there is installed a gear whose friction force makes it possible to apply a braking force to the switch plate. On the rear portion of the bracket 13, there is fixed a supporting piece 17 on which a guide jut 17*a* is formed. The guide jut 17*a* is accommodated within the groove 10*d*, and makes it possible for the switch plate 100 to rotate only within a certain angular range. A vertical supporting part 13*a* is formed on the bracket 13 for attaching the bracket 13 to a supporting part 1*a* of the television by a screw. A holder 21 is fixed to the supporting piece 17. A sliding jut 21*a* of the holder 21 supports a cover 11, so that any undesired movement of the switch plate 100 can be prevented.

Figure 4:
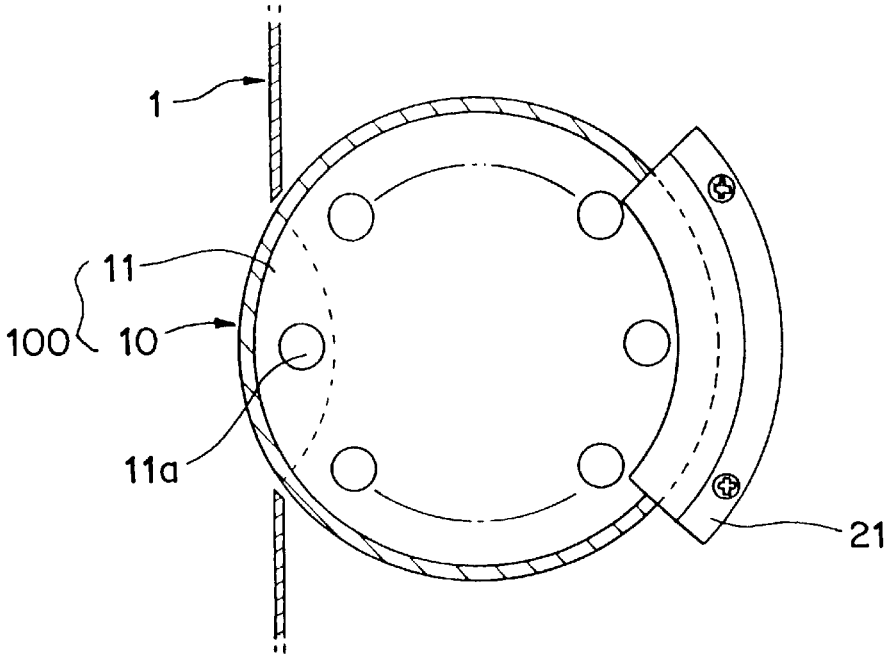
FIG. 4 a sectional view taken along a line B—B of FIG. 3.

FIG. 4 is a sectional view taken along a line B—B of FIG. 3. As shown in this drawing, tack switches 12*a* are installed at certain angular intervals correspondingly with knobs 11*a* of the cover 11. A portion of the television body is cut out, so that some switches are selectively exposed.

Figure 5:
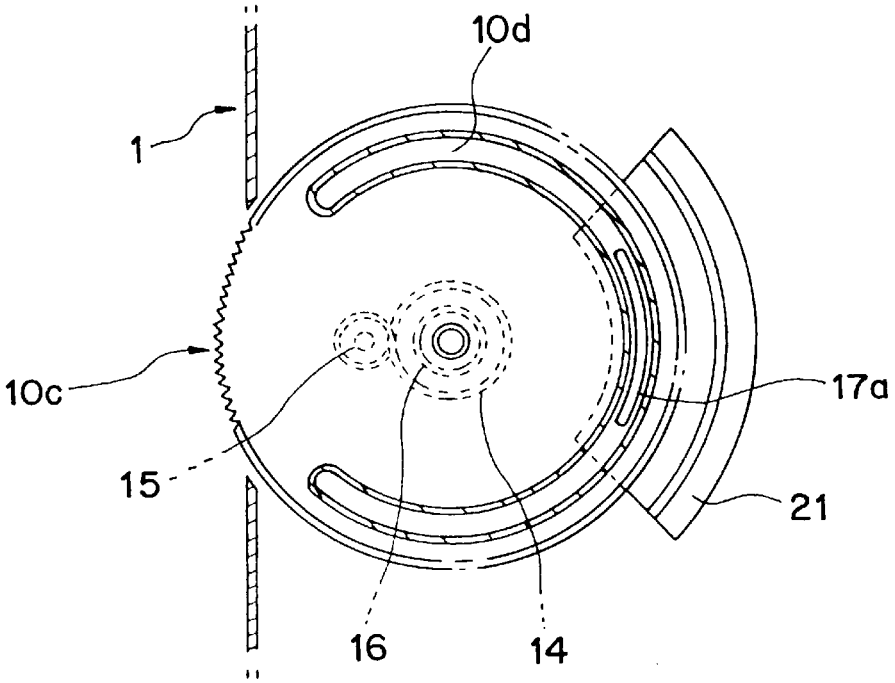
FIG. 5 sectional view taken along a line C—C of FIG. 3.
Figure 6:
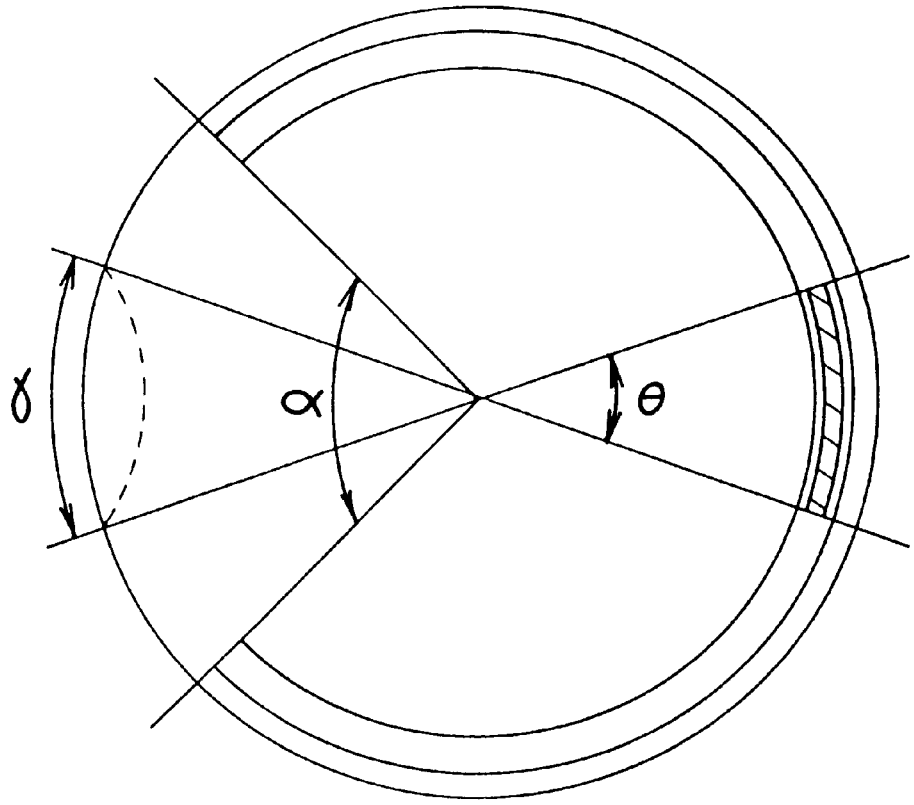
FIG. 6 is a schematic illustration showing the arc angles for the switch plate and the guide jut.

FIG. 5 is a sectional view taken along a line C—C of FIG. 3. The guide jut 17*a* of the supporting piece 17 is engaged with the arcuate groove which is formed on the bottom of the switch plate 100. Therefore, the switch plate 100 can be rotated within a certain angular range. As shown in the drawing, a gear 15 which is supported by a gear shaft 13*b* is meshed with gear 14 of supporting part 10*a* of the switch plate 100.

Assume that the angular range having no guide groove 10*d* is $\alpha$, that the angular range of the guide jut 17*a* is $\Phi$, and that the angular range corresponding to cut-out portion of the television body is $\tau$. Then the total angular range, in degrees, of the switch plate that is exposable is $360-\alpha-\Phi+\tau$. The rotatable angle, in degrees, of the switch plate 100 is $360-\alpha-\tau$. The manipulable range of the switch plate 100 can be varied by adjusting the length of the guide groove 10*d* and the guide jut 17*a* in accordance with the arrangement and number of the installed switches. However, in order to prevent twisting of the wires which pass through the supporting shaft 16 of the switch plate 100, it is preferable to set a $\alpha+\tau$ to 20 degrees or more.

Due to the arrangement of the above described components, the user can rotate the switch plate 100 clockwise or counterclockwise, so that the needed function switches of the switch plate 100 can be exposed through open portion 1*b*.

According to the present invention as described above, function switches are installed within an electronic apparatus in hidden form for selective exposure. Therefore, the aesthetic appearance of the electronic apparatus is improved.

Further, a projecting portion is eliminated, and therefore, inadvertent damage is avoided.

Further, the volume occupied by the switches is small compared with the number of the function switches, and therefore the electronic apparatus can be made compact.

It should be apparent to those of ordinary skill in the art that various changes and modifications can be added without departing from the scope of the present invention. The present invention should not be limited by the above described preferred embodiment, but only by the appended claims.

What is claimed is:

1. A control device for an electronic apparatus, comprising:

a rotatable switch plate for selectively exposing function switches to an outside of the electronic apparatus;

a switch means disposed on said switch plate, for generating manipulating signals;

a means for transmitting the manipulating signals of said switches to the electronic apparatus; and a supporting means for rotatably supporting said switch plate.

2. The control device as claimed in claim 1, wherein said switch plate has a flat cylindrical shape, and said switch means is installed on a flat face of said switch plate.

3. The control device as claimed in claim 2, wherein there are braking means disposed around said switch plate at various separated angular positions.

4. The control device as claimed in claim 2, further comprising a means for limiting rotation of said switch plate in two directions.

5. The control device as claimed in claim 1, wherein said switch plate includes projections formed on a side thereof so that said switch plate can be easily rotated by hand.

6. The control device as claimed in claim 5, wherein there are braking means disposed around said switch plate at various separated angular positions.

7. The control device as claimed in claim 1, wherein said supporting means comprises:

a supporting part extending downward from the center of a bottom of said switch plate;

a bracket for securing said switch plate to a body of the electronic apparatus; and a supporting shaft fixed to said bracket, for rotatably supporting said supporting part.

8. The control device as claimed in claim 1, wherein said transmitting means consists of a multiple channel cable with its one end connected to said switch plate, and with its other end for connection to circuits of the electronic apparatus.

9. A control device for an electronic apparatus, comprising:

a flat cylindrical rotatable switch plate for selectively exposing function switches to an outside of the electronic apparatus, said switch plate having an arcuate groove on its bottom, and having a supporting part extending downwardly from the center of its bottom;

a switch means disposed on said switch plate, for generating manipulating signals;

a cable with its one end connected to said switch plate, and its other end for connection to circuits of the electronic apparatus;

a bracket for fixation to a body of the electronic apparatus;

a supporting shaft fixed to said bracket, for rotatably supporting said supporting part; and a supporting piece fixed to said bracket, and having a guide jut for limiting rotations of said switch plate, said guide jut being inserted into said arcuate groove.

10. An electronic apparatus comprising:

a rotatable switch plate for selectively exposing function switches to an outside of the electronic apparatus;

a switch means disposed on said switch plate, for generating manipulating signals;

a means for transmitting the manipulating signals of said switches to the electronic apparatus; and a supporting means for rotatably supporting said switch plate.

11. The electronic apparatus as claimed in claim 10, wherein said switch plate has a flat cylindrical shape, and said switch means is installed on a flat face of said switch plate.

12. The electronic apparatus as claimed in claim 10, wherein said switch plate includes projections formed on a side thereof so that said switch plate can be easily rotated by hand.

13. The electronic apparatus as claimed in claim 12, wherein there are braking means disposed around said switch plate at various separated angular portions.

14. An electronic apparatus comprising:

a flat cylindrical rotatable switch plate for selectively exposing function switches to an outside of the electronic apparatus said switch plate having an arcuate groove on its bottom and having a supporting part extending downward from the center of its bottom;

a switch means disposed on said switch plate, for generating manipulating signals;

a cable with one end connected to said switch plate, and with its other end for connection to circuits of the electronic apparatus;

a bracket for fixation to a body of the electronic apparatus;

a supporting shaft fixed to said bracket, for rotatably supporting said supporting part; and a supporting piece fixed to said bracket, and having a guide jut for limiting rotations of said switch plate, said guide jut being inserted into said arcuate groove.

15. A control device for an electronic apparatus, comprising:

a rotatable switch plate for selectively exposing function switches to an outside of the electronic apparatus;

at least one switch of the function switches disposed on said switch plate;

a transmission conduit which connects the at least one switch to the electronic apparatus; and a supporting member that rotatably supports the switch plate.

16. The control device as in claim 15, wherein said switch plate comprises a printed circuit board having a flat cylindrical shape, and said at least one switch is installed on a flat face of the switch plate.

17. The control device as claimed in claim 16, wherein there is at least one braking member connected to said switch plate.

18. The control device as claimed in claim 17, wherein there are a plurality of braking members disposed around said switch plate at various separate angular positions.

19. The control device as in claim 15, wherein said switch plate includes projections formed on a side thereof so that said switch plate can be easily rotated by hand.

20. The control device as claimed in claim 15, wherein said support member comprises:

a supporting part extending downward from the center of a bottom of said switch plate;

a bracket for securing said switch plate to a body of the electronic apparatus; and a supporting shaft fixed to said bracket, wherein said shaft rotatably supports said supporting part.

* * * * *